United States Patent [19]

Weisman

[11] 4,122,860

[45] Oct. 31, 1978

[54] COIN SORTING APPARATUS

[76] Inventor: Eli Weisman, 6838 N. Ninth St., Philadelphia, Pa. 19126

[21] Appl. No.: 763,351

[22] Filed: Jan. 28, 1977

[51] Int. Cl.[2] ..... G07D 3/10

[52] U.S. Cl. ..... 133/3 B; 133/3 C

[58] Field of Search ..... 133/3 R, 3 B, 3 C; 209/83, 85, 86, 87

[56] References Cited

U.S. PATENT DOCUMENTS

| | | | |
|---|---|---|---|
| 1,149,615 | 8/1915 | Batdorf | 133/3 B |
| 1,411,848 | 4/1922 | Klove | 133/3 B |
| 3,771,693 | 11/1973 | Jessick | 221/200 X |

FOREIGN PATENT DOCUMENTS

| | | | |
|---|---|---|---|
| 93,036 | 2/1922 | Switzerland | 209/680 |
| 252,821 | 10/1948 | Switzerland | 209/680 |
| 254,332 | 6/1926 | United Kingdom | 133/3 B |

*Primary Examiner*—Robert B. Reeves
*Assistant Examiner*—Francis J. Bartuska
*Attorney, Agent, or Firm*—Robert D. Farkas

[57] ABSTRACT

A coin sorting apparatus which includes a plurality of nestling cup-like members dimensioned to be coextensively inserted in each other and thereby stacked, a group of apertures being located in the base portion of each of the plurality of nestling cup-like members, the groups of apertures being progressively graduated in size, the uppermost cup-like member having a group of apertures of the largest size located therein, the lowermost cup-like member having a group of apertures of the smallest size located therein, a housing having an open-ended chamber disposed therein, the housing for accepting the insertion of one of the nestling cup-like members, and electric motor operated semi-flexible cams for vibrating the plurality of nestling cup-like members when inserted in the open-ended chamber, the vibration of the plurality of nestling cup-like members permitting the selective passage of coins through the groups of apertures, the coins thereby being sorted.

7 Claims, 3 Drawing Figures

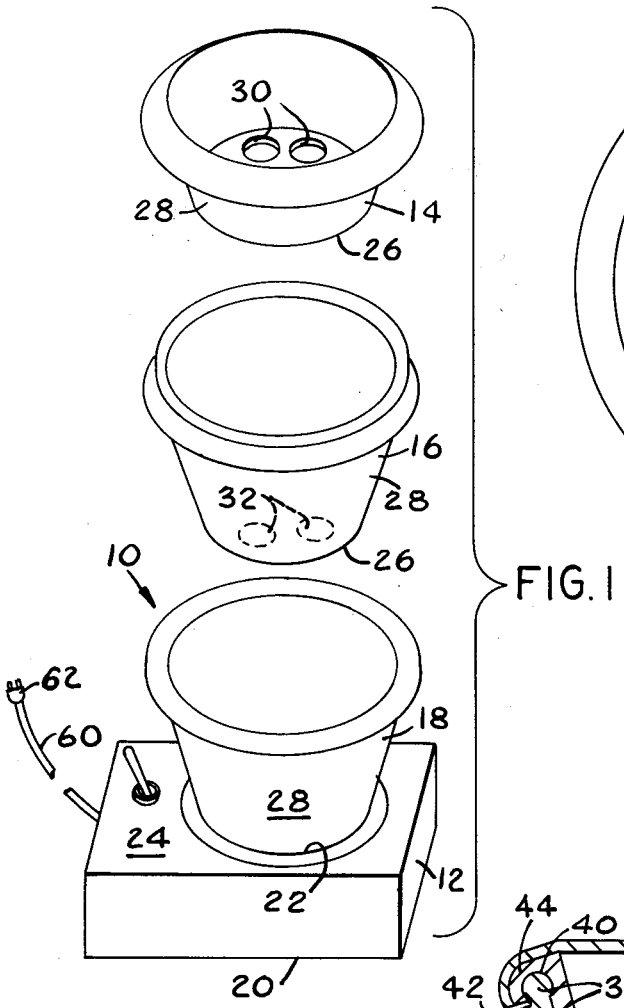
FIG. 1
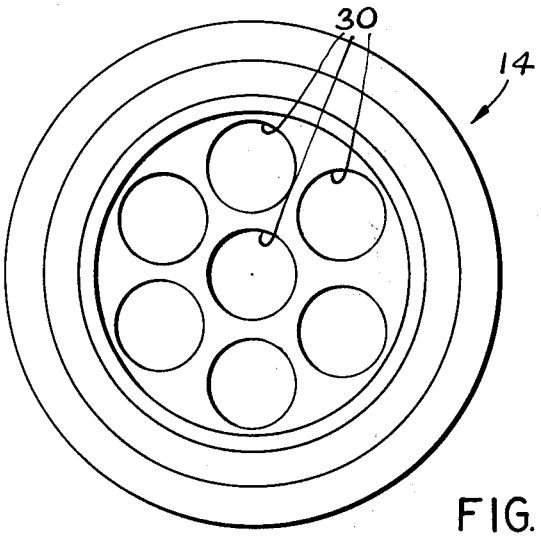
FIG. 2
FIG. 3
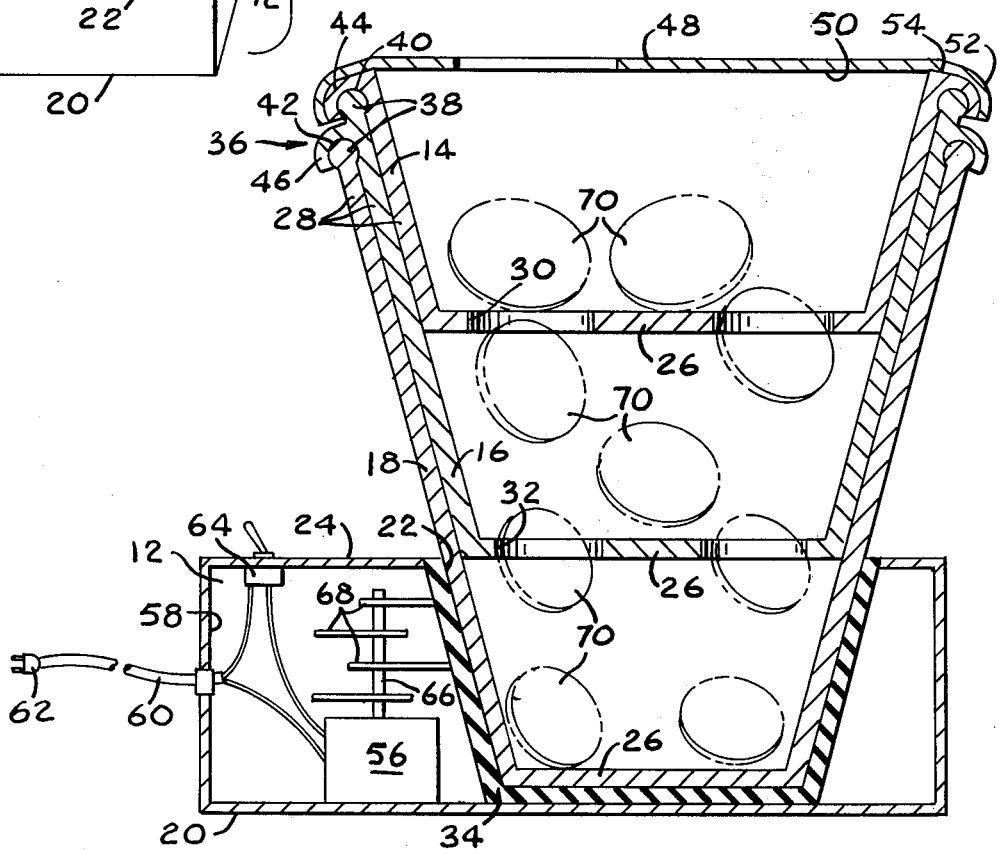

COIN SORTING APPARATUS

BACKGROUND OF THE INVENTION

1. Field of the Invention

The present invention relates to coin sorting apparatuses, and more particularly, to an automatic coin sorting apparatus.

2. Description of the Prior Art

The tedious task of sorting coins of various denominations is well-known. Manual coin sorting is extremely time consuming especially when large quantities of coins must be separated. With the widespread use of vending machines and the like efficient methods of sorting coins have become very important. Presently, known devices for coin sorting fall into two categories, complex automatic coin sorters, and the less expensive manual coin sorters. The manual coin sorters are relatively simple in design but are severly deficient in that they must be constantly shaken to sort coins. This task in itself can tend to be rather burdensome.

Typical of the manually operated coin sorting devices is the coin separator disclosed in U.S. Pat. No. 1,149,615 issued to C. S. Batdorf on Aug. 10, 1915. This device includes a housing and a plurality of trays for insertion therein. Each of the trays have different size apertures located in the bottom portions thereof. When a mixture of coins is poured into the uppermost tray, the user shakes the housing thereby causing the coins to sequentially fall through the graduated apertures located in the trays.

U.S. Pat. No. 1,411,848 issued to G. A. Klove on Apr. 4, 1922 teaches a coin sorter which includes a plurality of superposed trays which telescope together. The base portions of each of the trays are provided with a plurality of apertures which are graduated in size. The user must shake the trays to cause the sorting of the coins placed therein.

The present invention overcomes the problems associated with the prior art by providing a coin sorting apparatus which automatically separates mixtures of coins without the expenditure of manual effort by the user.

SUMMARY OF THE INVENTION

Therefore, a primary object of the present invention is to provide a coin sorting apparatus which may be employed to separate mixtures of coins of various denominations without the expenditure of manual effort on the part of the user.

A further object of the present invention is to provide a coin sorting apparatus which sorts mixtures of coins rapidly.

A still further object is to provide a coin sorting apparatus which is relatively compact in size.

Another object is to provide a coin sorting apparatus which provides a discrete separable collection area for each denomination of coins.

Still another object is to provide a coin sorting apparatus which is simple in design, inexpensive to manufacture, and durable.

These objects, as well as further objects and advantages, of the present invention will become readily apparent after reading the description of a non-limiting illustrative embodiment and the accompanying drawing.

A coin sorting apparatus according to the principles of the present invention includes in combination a plurality of nestling cup-like members, each having sidewalls and a base portion, each of the plurality of nestling cup-like members dimensioned to be partially coextensively inserted in an adjacent one of the plurality of nestling cup-like members, each of the plurality of nestling cup-like members except one having a group of similarly sized apertures located in the base portion thereof, the groups of apertures being progressively graduated in size; a housing for resting on a supporting surface, the housing having an open-ended chamber located therein, the open-ended chamber opening through the uppermost surface of the housing, the open ended chamber dimensioned to accept the insertion therein of the nestling cup-like member not having one of the groups of apertures located therein; and means for vibrating the plurality of nestling cup-like members, the vibrating means disposed within the housing.

BRIEF DESCRIPTION OF THE DRAWINGS

In order that the present invention may be more fully understood it will now be described, by way of example, with reference to the accompanying drawings in which:

FIG. 1 is an exploded pictorial representation of the preferred embodiment incorporating the principles of the present invention therein;

FIG. 2 is a top view of one of the nestling cup-like members of the preferred embodiment; and FIG. 3 is a side cross-sectional view in elevation of the preferred embodiment.

DESCRIPTION OF THE PREFERRED EMBODIMENT

Referring now to the figures, and more particularly to FIG. 1, there is illustrated therein a coin sorting apparatus 10 which includes a housing 12 and a plurality of nestling cup-like members 14, 16 and 18. The lowermost surface 20 of the housing 12 is configured for resting on a supporting surface. An open-ended chamber 22 is provided in the housing 12 and opens through the uppermost surface 24 thereof. The nestling cup-like member 18 is illustrated inserted in the open-ended chamber 22 of the housing 12. Each of the nestling cup-like members 14, 16 and 18 provide a bottom base portion 26 and sidewalls 28. The sidewalls 28 are preferably inclined outwardly from the base portions 26 as illustrated. The nestling cup-like members 14, 16 and 18 are dimensioned to be partially coextensively inserted in each other and thereby stacked as illustrated in FIG. 3. The cup-like member 14 has a group of apertures 30 located in the base portion 26 thereof and the cup-like member 16 has a group of apertures 32 located in the base portion 26 thereof. The group of apertures 30 are each larger in size than the group of apertures 32. The apparatus 10, as illustrated, may be employed for sorting three different sized coins. If the sorting of a larger quantity of coins is desired the user need only increase the number of cup-like members providing they have the proper size apertures in their base portion.

FIG. 2 illustrates a top view of the cup-like member 14. The group of apertures 30 is clearly illustrated in the base portion 26. Although the group of apertures 30 is shown in a particular configuration, other configurations may be used.

FIG. 3 illustrates the plurality of nestling cup-like members 14, 16, and 18. The cup-like member 18 is shown inserted in the open-ended chamber 22 of the housing 12. The open-ended chamber 22 is provided with a cup shaped semi-resilient member 34. The cup shaped semi-resilient member 34 is dimensioned to capture and removeably frictionally retain therein the cup-like member 18. The nestling cup-like members 14, 16, and 18 are kept together during the coin sorting process by the provision of an interlocking means 36. The interlocking means 36 includes lips 38 provided on the free edges 40 and 42, respectively, of the cup-like members 16 and 18. The lips 38 have a substantially circular cross-section. Hook-like flanges 44 and 46 are provided by the sidewalls 28, respectively, of the cup-like members 14 and 16. When the cup-like members 14, 16, and 18 are stacked together as illustrated, the hook-like flanges 44 and 46, respectively, removeably frictionally engage the lips 38 provided by the free edges 40 and 42, respectively, of the cup-like members 16 and 18. The coin sorting apparatus 10 is preferably provided with a cover 48 for covering the open end 50 of the cup-like member 14. The cover 48 is secured to the cup-like member 14 by an integrally formed inwardly biased rim 52 which engages the free edges 54 of the cup-like member 14. The cover 48 may be provided with a slot located therethrough.

An electric motor 56 is fixedly secured within the chamber 58 formed by the housing 12. The electric motor 56 is operably connected to a line cord 60 terminated in a plug 62 and an on-off switch 64. The on-off switch 64 is preferably of the toggle type. The electric motor 56 is preferably adapted to be powered by conventional house current and provides a driven shaft 66. A plurality of semi-flexible eccentric cams 68 are fixedly secured and radially extend from the driven shaft 66. The semi-flexible eccentric cams 68 are spaced apart and alternately sequentially strike the cup shaped semi-resilient member 34 as the driven shaft 66 rotates. The striking of the eccentric cams 68 against the cup shaped semi-resilient member 34 causes the cup-like members 14, 16, and 18 to be vibrated. A plurality of different sized coins 70 is illustrated within the cup-like members 14, 16, and 18.

In operation, the cup-like member 14 is filled with a plurality of coins of assorted sizes. The on-off switch 64 is moved to the on position thereby activating the electric motors 56. As the driven shaft 66 of the electric motor 56 rotates the semi-flexible eccentric cams 68 strike the cup shaped semi-resilient member 34 thereby causing vibration of the cup-like members 14, 16, and 18. As the nestling cup-like members 14, 16, and 18, vibrate the coins originally placed within the cup-like member 14 fall through the groups of apertures 30 and 32 as permitted by their size. When the sorting operation is completed coins of the largest size will be trapped within the cup-like member 14, coins of intermediate size will be trapped within the cup-like member 16, and coins of the smallest size will be trapped within the cup-like member 18. The cup-like members 14, 16, and 18 may then be separated and the sorted coins may be removed therefrom for further handling. The coin sorting apparatus 10 as illustrated is configured for sorting nickels, dimes, and quarters. With the addition of other cup-like members additional denominations of coins may also be sorted simultaneously.

All of the major components of the coin sorting apparatus 10 may be constructed of plastic or the like to reduce the expense of manufacture. A single housing may be supplied with several sets of cup-like members so coin sorting can be carried out as a continuous process i.e. one group of coins can be sorting while another group is being placed in a second set of cup-like members.

Therefore, a primary advantage of the present invention is to provide a coin sorting apparatus which may be employed to separate mixtures of coins of various denominations without the expenditure of manual effort on the part of the user.

A further advantage of the present invention is to provide a coin sorting apparatus which sorts mixtures of coins rapidly.

A still further advantage is to provide a coin sorting apparatus which is relatively compact in size.

Another advantage is to provide a coin sorting apparatus which provides a discrete separable collection area for each denomination of coins.

Still another advantage is to provide a coin sorting apparatus which is simple in design, inexpensive to manufacture, and durable.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention what is claimed is:

1. A coin sorting apparatus comprising in combination:

a plurality of nestling cup-like members, each having sidewalls and a base portion, each of said plurality of nestling cup-like members dimensioned to be partially co-extensively inserted in an adjacent one of said plurality of nestling cup-like members, each of said plurality of nestling cup-like members except one having a group of similarly sized apertures located in said base portion thereof, said groups of apertures being progressively graduated in size;

a housing for resting on a supporting surface, said housing having an open-ended chamber located therein, said open-end chamber opening through the uppermost surface of said housing, said open-ended chamber dimensioned to accept the insertion therein of said nestling cup-like member not having one of said groups of apertures located therein;

a cup shaped semi-resilient member, said semi-resilient member disposed within said open-ended chamber of said housing, said semi-resilient member for capturing and frictionally retaining one of said cup-like members when inserted therein; and means for vibrating said plurality of nestling cup-like members, said vibrating means disposed within said housing.

2. A coin sorting apparatus as claimed in claim 1, further comprising a cover for placement on the uppermost said cup-like member when said plurality of cup-like members are nestled together.

3. A coin sorting apparatus as claimed in claim 1, wherein said vibrating means comprises an electric motor mounted within said housing adjacent to said open-ended chamber, said electric motor providing a driven shaft, a plurality of semi-flexible eccentric cams fixedly secured to said driven shaft in a spaced radial relationship, the rotation of said driven shaft causing said semi-flexible eccentric cams to sequentially strike one of said cup-like members inserted in said open-ended chamber.

4. A coin sorting apparatus as claimed in claim 3, further comprising an on-off switch operably coupled to said electric motor.

5. A coin sorting apparatus as claimed in claim 1, further comprising means for selectively interlocking said cup-like members.

6. A coin sorting apparatus as claimed in claim 5, wherein said selectively interlocking means comprises a lip provided on the free edge of at least one of said plurality of nestling cup-like members, said lip having a substantially circular cross-section, a hook like flange being provided by the sidewall of at least another of said cup-like members, said hook like flange for capturing and removably frictionally engaging said lip of said at least one cup-like member when said at least one and said at least another cup-like members are nestled together.

7. A coin sorting apparatus as claimed in claim 1, wherein said sidewalls of each of said plurality of cup-like members are inclined outwardly from said base portion thereof.

* * * * *